US006141832A

United States Patent [19]

Salice

[11] Patent Number: 6,141,832

[45] Date of Patent: Nov. 7, 2000

[54] WIDE-ANGLE HINGE

[75] Inventor: Luciano Salice, Carimate, Italy

[73] Assignee: Arturo Salice S.p.A., Novedrate, Italy

[21] Appl. No.: 09/069,629

[22] Filed: Apr. 29, 1998

[30] Foreign Application Priority Data

Apr. 30, 1997 [DE] Germany ..... 197 18 429
Jun. 5, 1997 [DE] Germany ..... 297 09 806 U

[51] Int. Cl.[7] ..... E05D 3/06

[52] U.S. Cl. ..... 16/366; 16/369; 16/370

[58] Field of Search ..... 16/366, 368, 369, 16/370, 272, 319

[56] References Cited

U.S. PATENT DOCUMENTS

| | | | |
|---|---|---|---|
| 1,269,403 | 6/1918 | Dianovszky, Sr. . | |
| 2,021,702 | 11/1935 | Soss | 16/369 |
| 2,135,280 | 11/1938 | Erickson | 16/369 |
| 2,137,751 | 11/1938 | Davis . | |
| 2,200,142 | 5/1940 | Witschi | 16/369 |
| 3,611,474 | 10/1971 | Meyer | 16/358 |
| 3,673,635 | 7/1972 | Cencioni . | |
| 3,864,786 | 2/1975 | Salice | 16/163 |
| 3,978,549 | 9/1976 | Vitt | 16/129 |
| 4,236,274 | 12/1980 | Omote et al. | 16/150 |
| 4,590,641 | 5/1986 | Lautenschlager et al. | 16/238 |
| 5,035,026 | 7/1991 | Carlo et al. | 16/288 |
| 5,465,463 | 11/1995 | Lautenschlager | 16/236 |
| 5,765,262 | 6/1998 | Salice | 16/336 |

FOREIGN PATENT DOCUMENTS

| | | |
|---|---|---|
| 289593 | 4/1971 | Austria . |
| 0200019 | 11/1986 | European Pat. Off. . |
| 0763642 | 3/1997 | European Pat. Off. . |
| 3202126 | 7/1983 | Germany . |
| 3312496 | 10/1984 | Germany . |
| 3830887 | 3/1990 | Germany . |
| 4241690 | 3/1994 | Germany . |

*Primary Examiner*—Anthony Knight
*Assistant Examiner*—Alison K. Pickard
*Attorney, Agent, or Firm*—Dilworth & Barrese

[57] ABSTRACT

The invention is directed to a wide-angle hinge having articulated arms in the form of U-shaped profiled levers, the lateral sides of which are offset from one another and with U-shaped profiled transverse swinging arms being articulated to the levers with the same offset. In an open position, hinge pins of both levers lie in an approximately cylindrical shell, the axis of which lies on the outer side of the hinge portions.

26 Claims, 8 Drawing Sheets

WIDE-ANGLE HINGE

BACKGROUND OF THE INVENTION

The invention concerns a wide-angle hinge with crossing articulated arms, the ends of which, on one side, are articulated with hinge parts attachable to a portion of the body and to a furniture part swinging horizontally and the other ends of which are linked by means of transversal swinging arms to the hinge portions at a distance from the articulations of the hinge arms, where the hinge arms are connected to each other in an articulated manner between their articulations.

Wide-angle hinges of this type are known in various methods of embodiment and have been described, for example, in DE 33 12 496 C2, U.S. Pat. No. 1,269,403, U.S. Pat. No. 2,137,751, EP 0 763 642 A1, IT 83 427 A/78 and U.S. Pat. No. 3,673,635.

SUMMARY OF THE INVENTION

The known hinges appear unattractive in the open position and frequently project inward, so that they narrow the clear space inside the body to the side of which they are nailed.

The object of the invention is to create a sunken wide-angle hinge of the type described at the beginning that does not significantly reduce the clear space inside the body while being sturdy in construction and having an attractive appearance in the open position.

Pursuant to the invention, this object is solved in that the articulated arms consist of U-shaped profiled levers, the lateral sides of which, articulated at the hinge portions and projecting beyond these connecting webs, are offset from each other such that they lie on the inside and outside, that the U-shaped profiled transversal swinging arms are articulated to the levers with the same offset and that, in the open position, the hinge pins of both levers lie in approximately a cylindrical shell, the axis of which lies on the outside of the hinge portions.

The levers and transversal swinging arms of the wide-angle hinge pursuant to the invention, in the open position, form practically an arc-shaped carrier, the height of which essentially does not exceed the width of the lateral side of the lever and transversal swinging arm. In this manner, the contiguous lateral sides of the lever and transversal swinging arm do not appear unattractive in the open position, since they provide a uniform arc-shaped appearance and they take up only a small space so that the open cross-section of the portion of the body to which the hinges are attached is not significantly reduced.

The lateral sides of the lever and/or transversal swinging arm are expediently bent at right angles such that they lie close together in their extended open position.

Pursuant to a preferred method of embodiment, provision is made so that the lateral sides of the lever are connected together only in their end regions and the lateral sides of the transversal swinging arms are essentially connected down to the coupling region by means of web plates such that the web plates of all levers and transversal swinging arms adjoin each other in the open position. In this method of embodiment, the web parts of the lever and transversal swinging arms form a practically complete cover surface in the open position of the hinge so that the levers and transversal swinging arms offer a closed, nice appearance.

In another method of embodiment, provision is made so that the bearing pins for the lateral sides of the levers and transversal swinging arms pass through the side walls of each portion of the hinge consisting of a hinge cup, in longitudinal slots, and are supported in a frame that is carried on a plate in a longitudinally-displaceable manner, which plate, in turn, is carried in the hinge cup in a diagonally-displaceable manner, while positioning devices, e.g., cams, are provided for said displacement in a diagonal and longitudinal direction. The method of embodiment of the wide-angle hinge thus permits simple adjustment of the furniture part in three common directions of adjustment.

Pursuant to another method of embodiment, provision is made so that the hinge portion nailed to a portion of the body consists of a U-shaped profiled hinge arm and the hinge portion that can be swung in a horizontal direction is made of a flat block with a level underside. In this method of embodiment, the hinge arm is in the form of the usual hinge arm in transversal swinging arm hinges that is attached to a portion of the body by means of a plate facilitating displacement. The hinge portion that can be swung horizontally can, for example, be attached to a glass door, and this, for example, by a simple glued connection.

Pursuant to another method of embodiment, a closing device is provided that consists of a bent leaf spring, the one end of which is supported on pegs between the lateral sides of a lever, that are located between the articulation connecting the levers and the coupling of the lever, and the other end of which impinges on a pin that is contained in the longitudinal slots of the lateral side of the same lever, that is located between the articulation connecting the levers and the coupling of the transversal swinging arm, and that the pin is adjacent to a closing curve with the desired closing characteristics that surround the drilled holes of the articulation of the lateral side of the transversal swinging arm connected therewith in an articulated manner.

BRIEF DESCRIPTION OF THE DRAWINGS

Methods of embodiment of the invention are explained in greater detail below based on the drawing in which.

DESCRIPTION OF THE PREFERRED EMBODIMENTS

Figure 1:
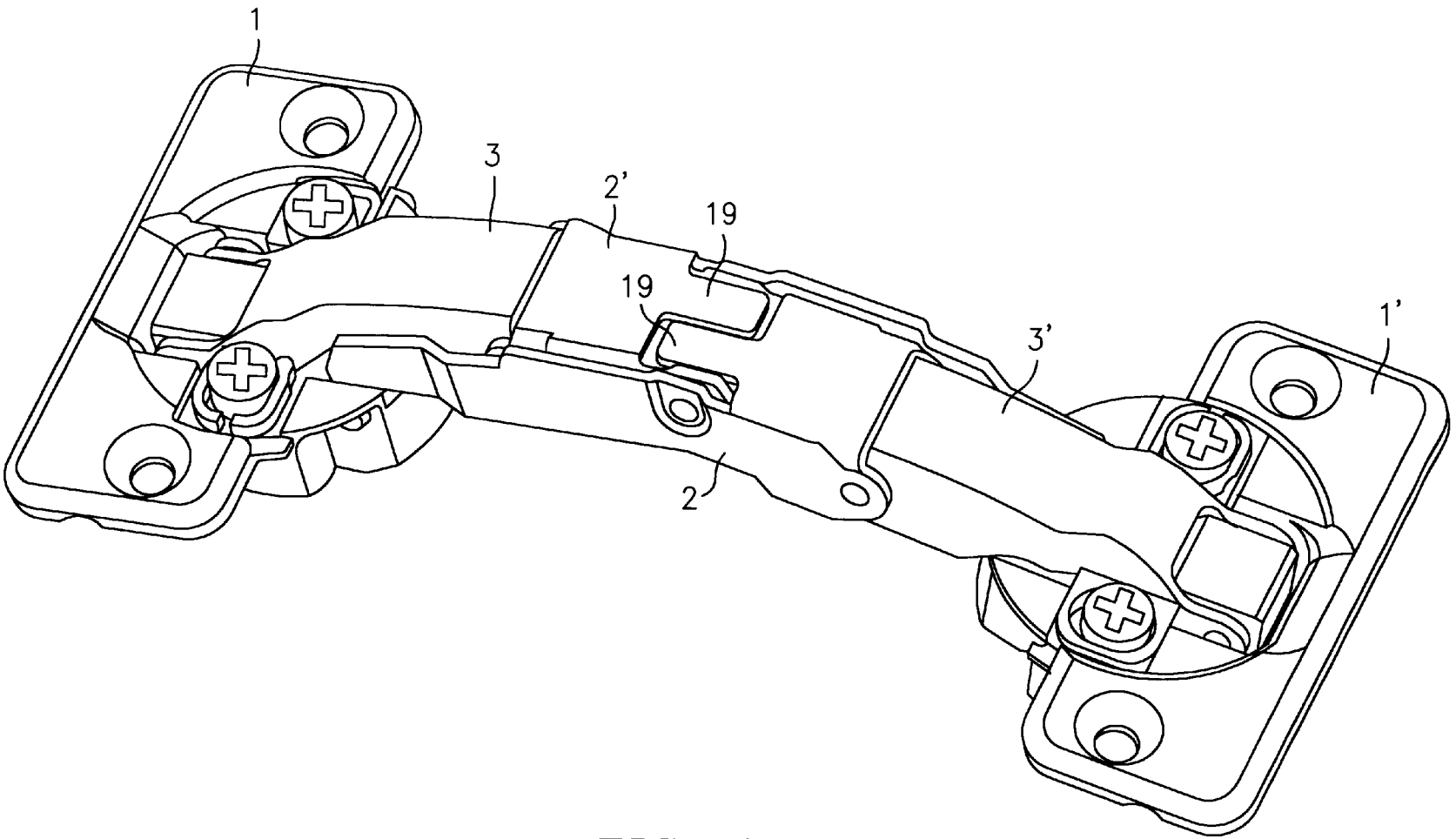
FIG. 1 is a perspective view of the first method of embodiment of the wide-angle hinge pursuant to the invention, in its open position.

A first method of embodiment of the wide-angle hinge pursuant to the invention is described based on FIGS. 1 through 7.

The wide-angle hinge consists of two common hinge cups 1,1', provided with attachment flanges that are nailed, in the usual manner, into countersinks in one wall of a portion of the body and a door or shutter coupled thereto. Wall 4 of the portion of the body and door 5 are shown by dotted lines in FIG. 6. Levers 2, 2' and transversal swinging arms 3, 3' are lodged in an articulated fashion on hinge bolts 6, 7, and 6', 7', parallel to each other, of hinge cups 1, 1'. Levers 2, 2', are connected together in an articulated fashion, crossing each other, by means of hinge bolt 8. Transversal swinging arms 3, 3' are connected with levers 2, 2' in an articulated fashion, by means of hinge bolts 9, 9'.

Figure 2:
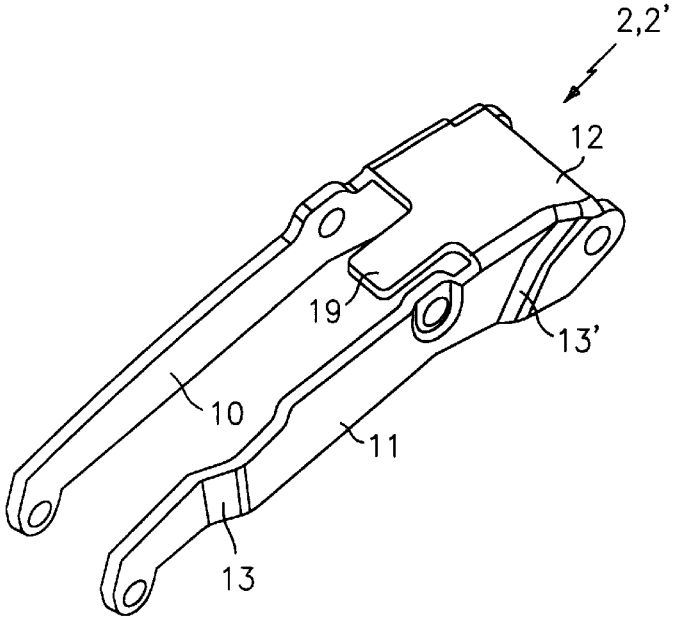
FIG. 2 is a perspective representation of one of the two identical levers of the wide-angle hinge pursuant to FIG. 1.
Figure 3:
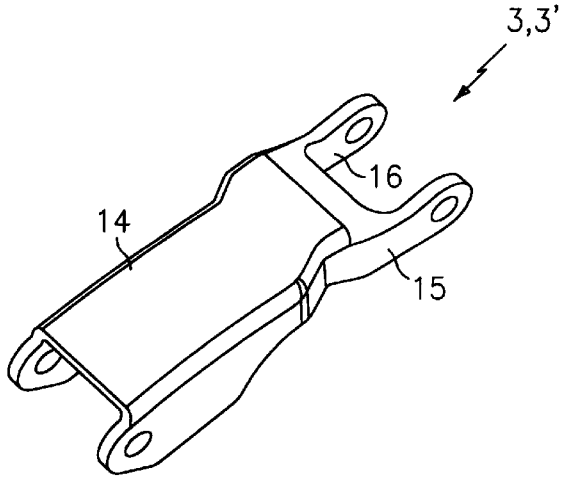
FIG. 3 is a perspective view of one of the two identical transversal swing arms of the wide-angle hinge pursuant to FIG. 1.
Figure 4:
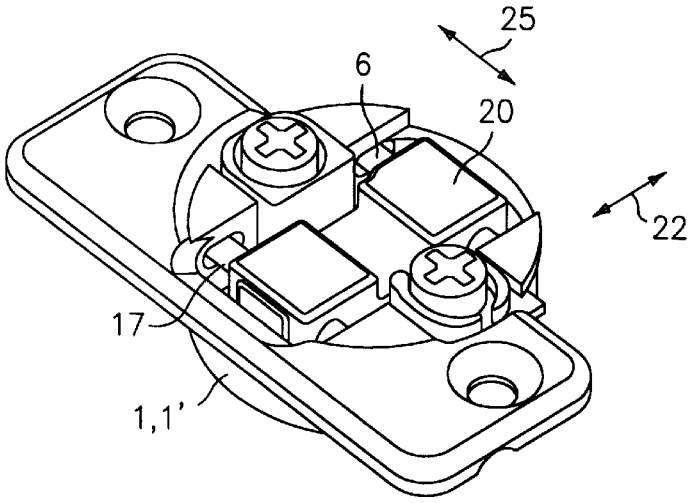
FIG. 4 is a perspective view of one of the two hinge parts of the wide-angle hinge pursuant to FIG. 1, without the lever and transversal swinging arm coupled thereto.
Figure 5:
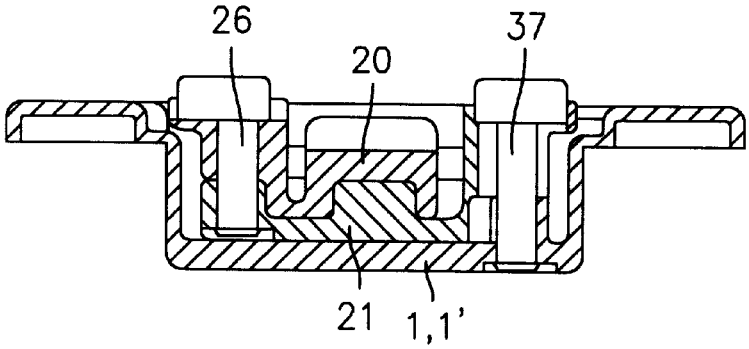
FIG. 5 is a cross-section through the hinge portion pursuant to FIG. 4.
Figure 6:
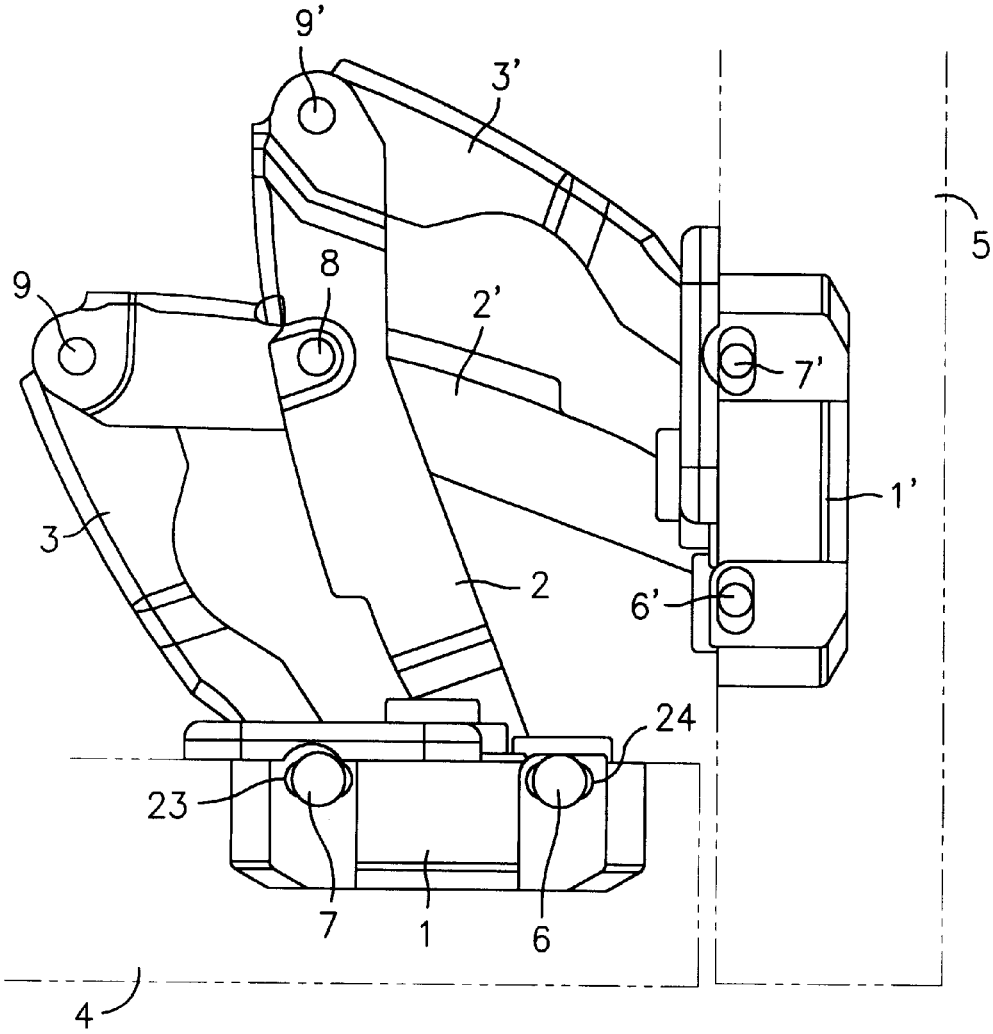
FIG. 6 is a side view of the wide-angle hinge pursuant to FIG. 1 in its closed position.

Levers 2, 2' and transversal swinging arms 3, 3' are formed identically, as can be seen from FIGS. 2 and 3, so that the wide-angle hinge is constructed symmetrically, where, however, the lever and transversal swinging arm are not symmetrical to their longitudinal axis.

Levers 2, 2' have a U-shaped profile, while its lateral sides 10, 11 are connected to each other only in the area of their outer ends, by means of web plate 12. The lateral sides are easily bent around a diagonal axis, as can be seen from FIGS. 2 and 6. Lateral side 10 is formed flat in a plane at right angles to web plate 12, while lateral side 11 is provided, in its end region lodged in the hinge cup, with wide right-angle bend 13, and is provided, in an end region connected in an articulated manner with transversal swinging arms 3, 3', with another wide right-angle bend 13'. Web plate 12 connects the lateral sides in the area between articulation axes 8 and 9, 9'.

Transversal swinging arms 3, 3' also have a U-shaped profile, where web plate 14 covers the area between the ends of the lateral sides with the bores of the bearings for the bearing journals. Lateral sides 15, 16 of transversal swinging arms 3, 3' are provided with a right angle bend, so that they lie close next to the lateral sides of levers 2, 2' in the extended position of the levers and transversal swinging arms in the open position, as seen in FIG. 1.

Figure 7:
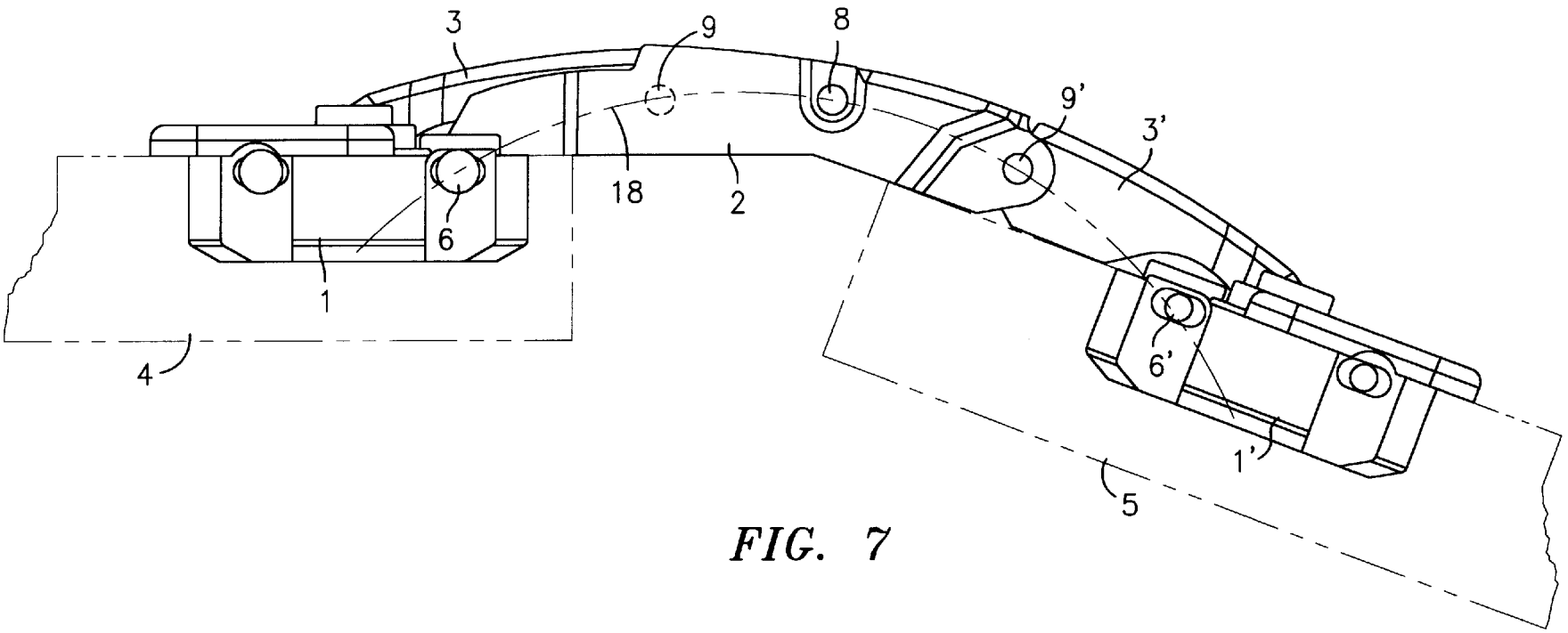
FIG. 7 is a side view of the wide-angle hinge pursuant to FIG. 1 in its open position.

The arrangement of hinge bolts 6, 6', 8 and 9, 9' of levers 2, 2' is selected, as can be seen from FIG. 7, in such manner that they lie on imaginary cylindrical shell 18, shown by the dashed line in FIG. 7, the axis of curvature of which is on the outside of the hinge cups and/or wall body 4 and door 5 carrying them.

Web plates 12, 14 of the levers and transversal swinging arms are arranged in relation to each other in such manner that they form an essentially continuous cover surface in the open position of the hinge, as can been seen from FIG. 1.

Web plates 12 have tongues 19, directed toward each other and offset to one another, that are adjacent to each other in the open position of the hinge in the manner shown in FIG. 1.

Hinge bolts 6, 7 for the levers and transversal swinging arms are supported in frame 20, which is carried on intermediate plate 21 in the direction of double arrow 22, in a longitudinally-displaceable manner. The ends of hinge bolts 6, 7 pass through the side walls of hinge cup 1, 1' in longitudinal slots 23, 24. Intermediate plate 21 is carried such that it is displaceable diagonally relative to hinge cup 1, 1' in the direction of double arrow 25. To displace fixed bracket 29 and intermediate plate 21, eccentric bolts 26, 27 are provided, bolt 27 of which is held such that it can rotate but not shift axially in the floor of hinge cup 1, 1', and bolt 26 is held such that it can rotate but not shift axially on intermediate plate 21. Philips heads are provided to rotate the eccentric bolts.

The second method of embodiment of the wide-angle hinge pursuant to the invention is now described based on FIGS. 8 through 16. In contrast to the wide-angle hinge pursuant to FIGS. 1 through 7, this one is not formed symmetrically. The hinge portion nailed to the body part consists of U-shaped, profiled hinge arm 30, that can be nailed in known manner to body wall 32 by means of plate 31, serving to adjust it. Movable hinge portion 33 consists of a flat, right-angle block with a level underside, that can be attached, for example, to glass door 34 by means of glue.

Figure 11:
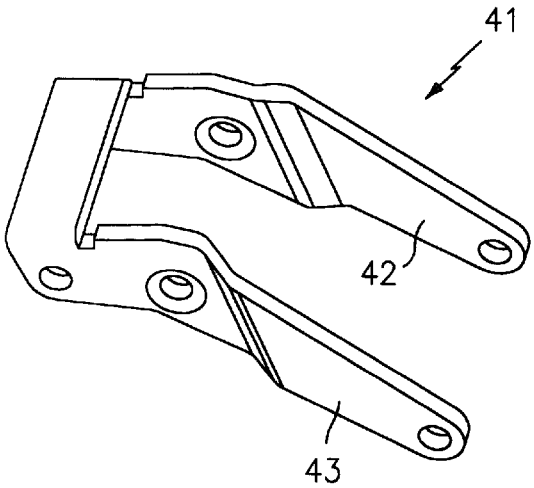
Figure 12:
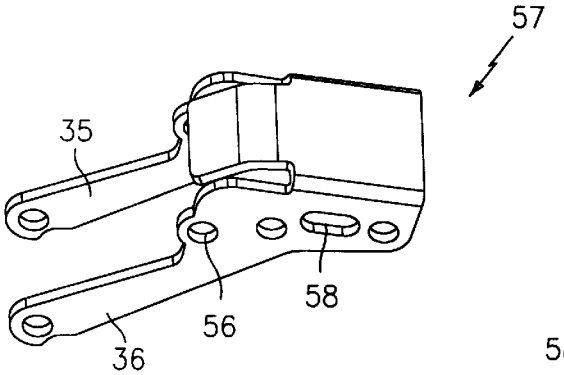

At a front, reduced-width extension 40 of hinge arm 30, clean-cut lateral sides 35, 36 of lever 37 are supported on hinge bolts 39. Clean-cut lateral sides 42, 43 of other lever 41, to be seen in FIG. 11, are supported on hinge bolt 44 of hinge part 33.

Figure 13:
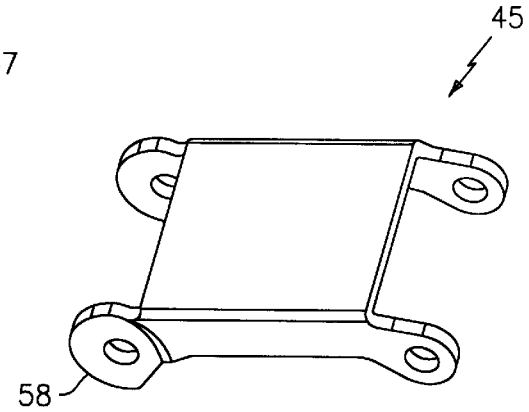
Figure 14:
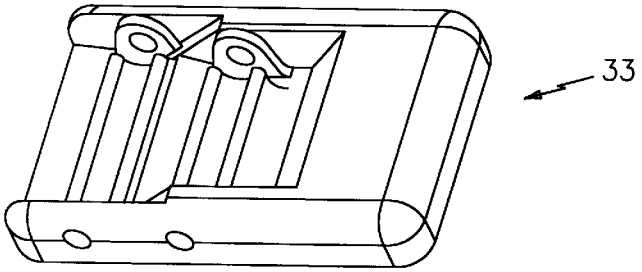
FIG. 14 is a perspective view of the movable hinge portion of the wide-angle hinge pursuant to FIG. 8, FIGS. 15 and 16 are side views of the wide-angle hinge pursuant to FIG. 8 in its closed and open position.

Transversal swinging arm 45 in FIG. 13 is supported on hinge bolt 46 of hinge portion 33. The crossing lateral sides of levers 37, 41 are connected together by means of hinge bolt 47.

Figure 8:
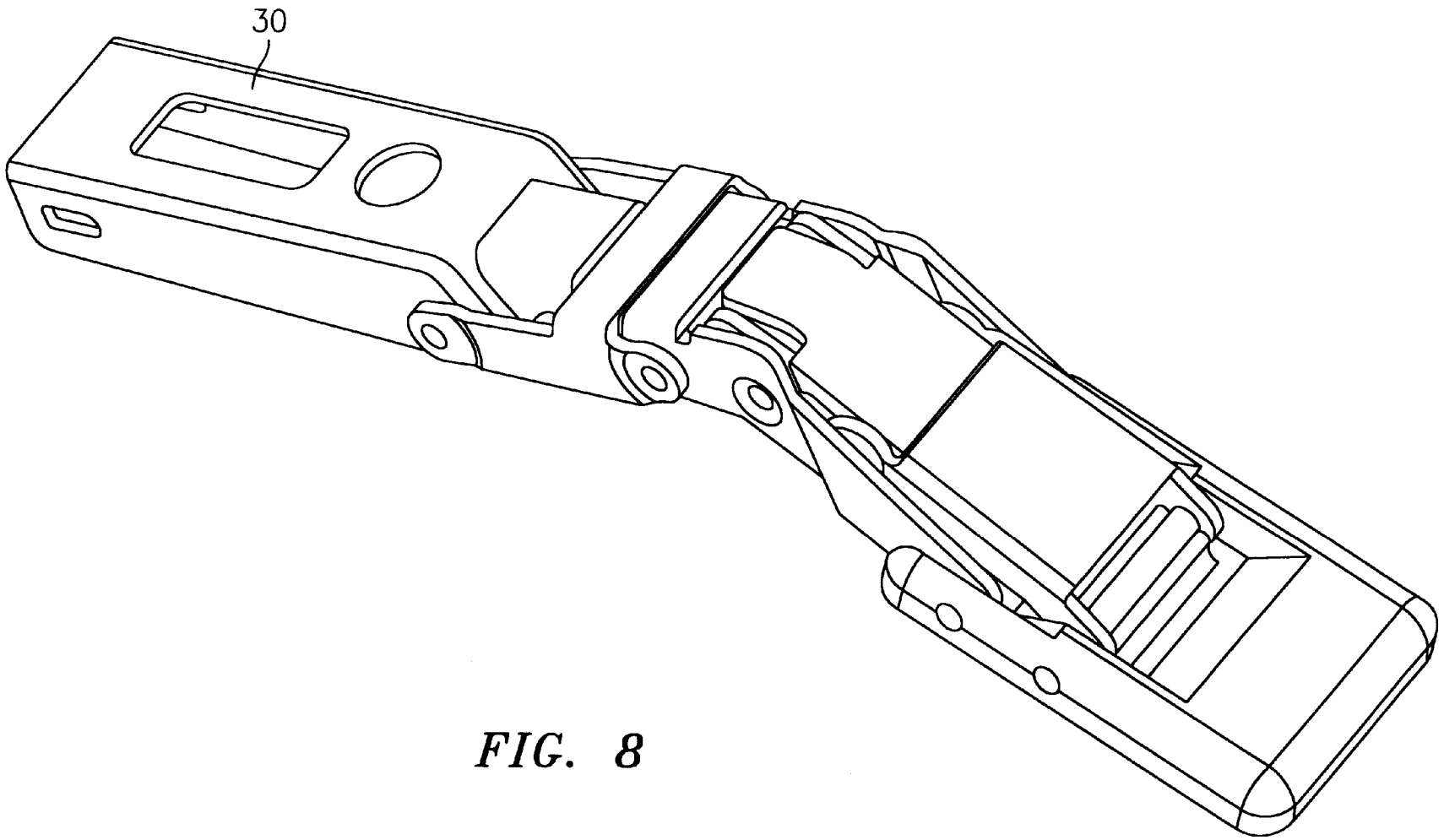
FIG. 8 is a perspective view of a second method of embodiment of the wide-angle hinge pursuant to the invention in its open position.
Figure 9:
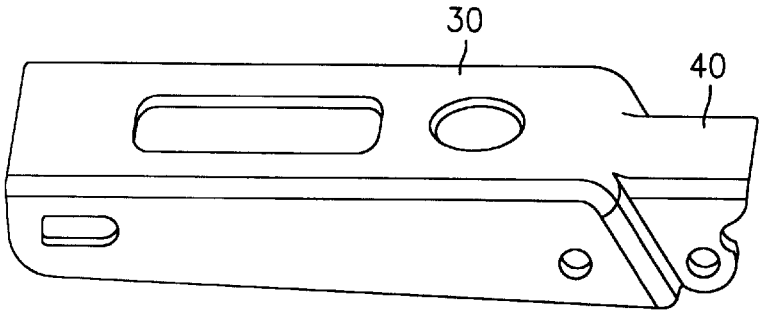
FIG. 9 is a perspective view of the hinge arm of the wide-angle hinge pursuant to FIG. 8, FIGS. 10 and 13 are perspective views of the two transversal swinging arms of the wide-angle hinge pursuant to FIG. 8, FIGS. 11 and 12 are perspective views of the lever of the wide-angle hinge pursuant to FIG. 8.
Figure 10:
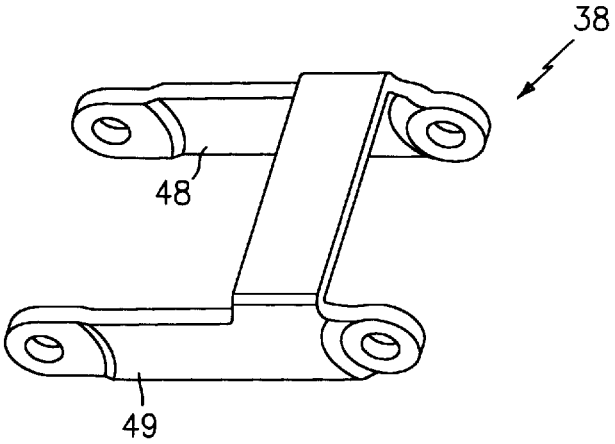

Lateral sides 35, 36 of lever 37 are overlapped by lateral sides 48, 49 of transversal swinging arm 38, as can be seen in FIG. 8. Lateral sides 42, 43 of lever 41 are bent outward at right angles, as can be seen in FIG. 11, so that they can overlap the lateral side of transversal swinging arm 45 in the manner shown in FIG. 8.

Levers 37 and 41 as well as transversal swinging arms 38 and 45 are provided with web plates connecting the lateral sides such that in the open position of the hinge seen in FIG. 8, they lie adjacent to each other and form an essentially flat cover surface.

The arrangement of hinge bolts 39, 44, 47 of the levers and of hinge bolts 50, 51, that connect the transversal swinging arm with the levers, is selected, in turn, such that they lie on imaginary cylindrical shell 52, indicated by dotted lines, the axis of which is on the outside of hinge parts 30, 33.

Figure 15:
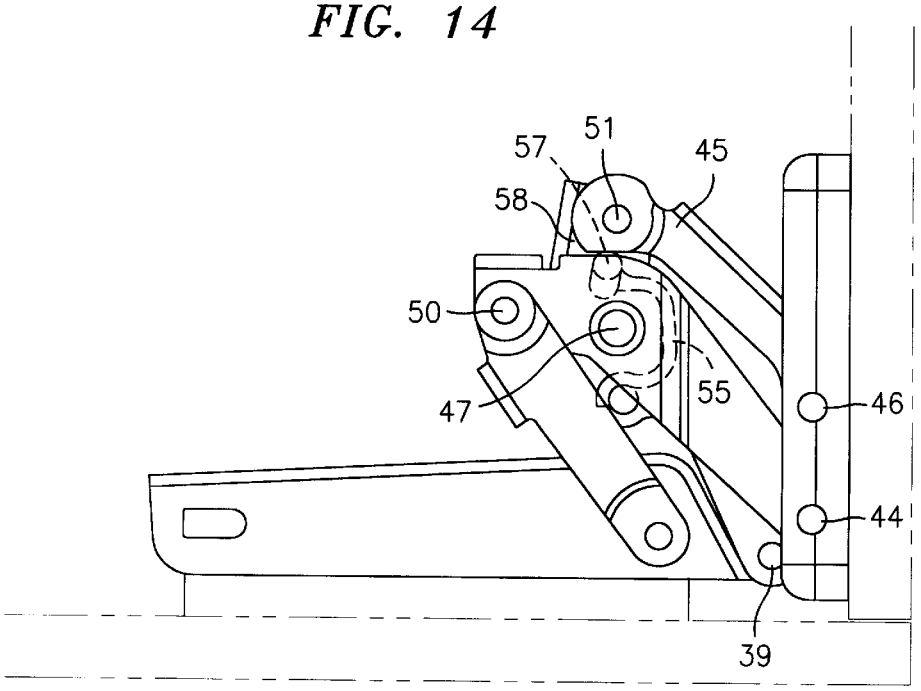
Figure 16:
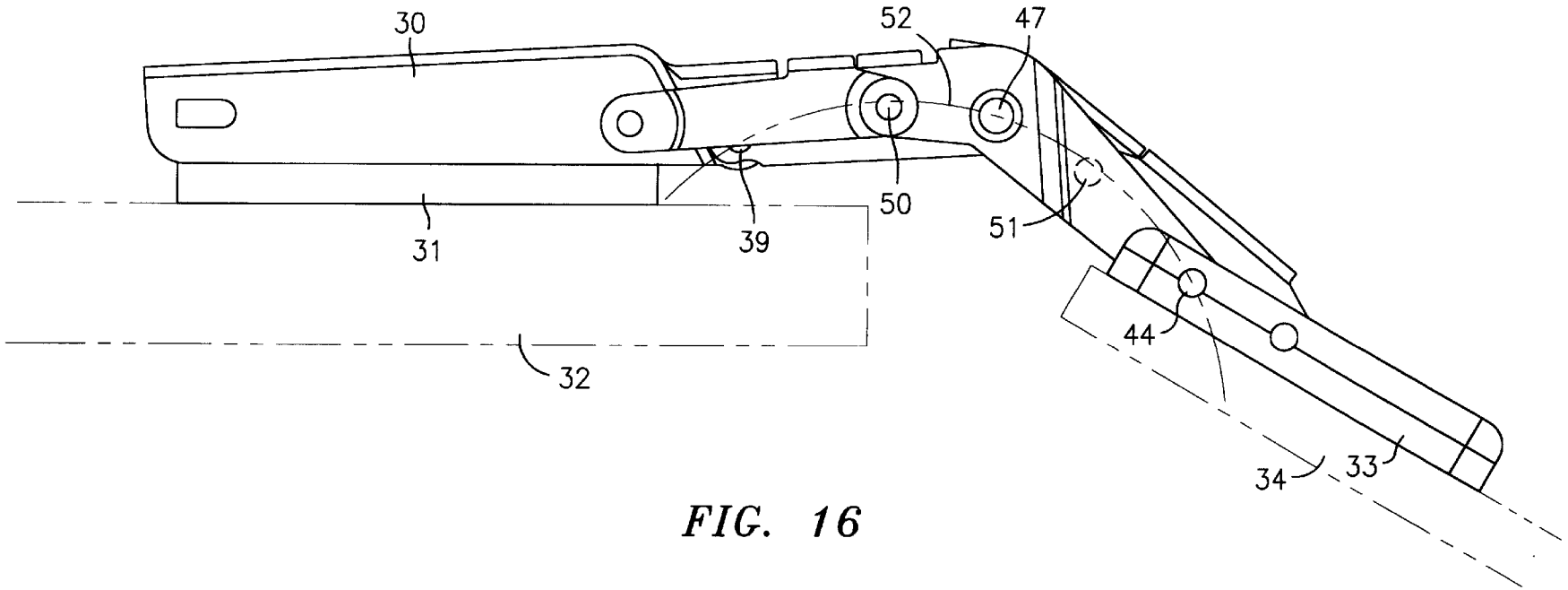

The wide-angle hinge can be provided with a closing mechanism that consists of C-shaped bent leaf spring 55, indicated by the dashed line in FIG. 15. The end of this leaf spring is supported on pegs 56, which are arranged on the inside of lateral sides 35, 36 of lever 37. The other end of the leaf spring is supported on pin 57 that is carried in a displaceable manner in longitudinal slots 58 of lateral sides 35, 36. Spring-loaded pin 57 is supported on a curve, corresponding to the desired opening characteristics, formed at the ends of the lateral sides of transversal swinging arm 45 and that borders hinge bolts 51. Leaf spring 55 borders hinge bolts 47 connecting levers 37 and 41 in the manner shown in FIG. 15.

What is claimed is:

1. Wide-angle hinge with crossing hinge levers (2,2') that are connected at one end and in an articulated manner with hinge parts (1, 1') attachable to a body part (4) and a horizontal-swing part (5) of a piece of furniture and at the other end to the hinge part (1,1') by transversal swinging arms (3,3') at a distance from articulations of the hinge levers (2,2'), wherein the hinge levers (2,2') are connected to each other in an articulated manner, characterized in that the hinge levers (2,2') consist of U-shaped profile levers, of which the lateral sides (10,11) coupled to the hinge parts (1,1') and projecting webs (12)connecting them are arranged offset to each other such that one lies inside and the other outside, the transversal swinging arms (3,3') which each are in the form of a U-shaped profile are coupled with the same offset to the levers (2,2') and in an extended open position, hinge pins (6,6',8,9,9') coupling said levers (2,2') and arms (3,3') and hinge parts (1,1') lie approximately in an imaginary cylindrical shell (18), the axis of which lies on an opposite side of the hinge parts (1,1') from said levers (2,2') and arms (3,3').

2. Wide-angle hinge pursuant to claim 1, characterized in that at least one lateral side (10, 11', 15, 16) of at least one of the levers (2,2') and the transversal swinging arms (3,3') is bent at right angles such that lateral sides of the levers and arms lie close together in the extended open position.

3. Wide-angle hinge pursuant to claim 2, characterized in that the lateral sides (10,11) of the levers (2,2') at end regions thereof and the lateral sides (15,16) of the transversal swinging arms, (3,3') are respectively connected together down to a coupling region by web plates (12,14) such that the web plates (12, 14) lie adjacent to all levers and transversal swinging arms in the extended open position.

4. Wide-angle hinge pursuant to claim 2, characterized in that bearing pins (6,7) for the lateral sides of the levers (2,2') and the transversal swinging arms (1,1') are arranged to pass through side walls of each hinge part (1,1') consisting of a hinge cup, in longitudinal slots (23,24) and are supported in a frame (20) that is carried on a plate (21) in a longitudinally displaceable manner, that in turn is carried in the hinge cup in a diagonally-displaceable manner, wherein adjustment of devices are provided for displacement in the diagonal and longitudinal directions.

5. Wide-angle hinge pursuant to claim 4, wherein the adjustment devices are cams (26, 27).

6. Wide-angle hinge pursuant to claim 2, characterized in that one of the hinge parts is arranged to be nailed to one body part (32) and consists of a U-shaped profiled hinge arm (30) and the other hinge part, arranged for moving or swinging consists of a flat block (33) with a level underside.

7. Wide-angle hinge pursuant to claim 2, characterized in that a closing mechanism is provided that consists of a bent leaf spring (55), of which one end is supported on pins (56) between the lateral sides (35, 36) of a lever (37) that are located between an articulation connecting the levers and coupling of the lever to the hinge part (30), and another end of which impinges on a pin (57) that is carried in longitudinal slots (58) of the lateral side of the same lever (37) that are located between the articulation (47) connecting the levers and coupling of one of the transversal swinging arms (45), and the pin (57) lies adjacent to a closing curve with the desired closing characteristics, that surrounds holes of articulation of the lateral side of the respective transversal swinging arm (45) connected therewith in an articulated manner.

8. Wide-angle hinge pursuant to claim 2, wherein one (11) of the lateral sides (10,11) of the lever (2,2') is bent around a diagonal axis with the other lateral side (10) thereof formed flat in a plane at a right angle to the web plate (12) connecting the lateral sides (10,11) to one another only in an area of outer ends of the lateral sides (10,11), and both lateral sides (15,16) of the respective swinging arm (3,3') are provided with a right angle bend so that these lateral sides (15,16) lie close next to the lateral sides (10,11) of the levers (2,2') in the extended open position.

9. Wide-angle hinge pursuant to claim 1, characterized in that lateral sides (10,11) the levers (2,2') at end regions thereof and lateral sides (15,16) of the transversal swinging arms (3,3') are respectively connected together down to a coupling region by web plates (12,14) such that the web plates (12,14) lie adjacent to all levers and transversal swinging arms in the extended open position.

10. Wide-angle hinge pursuant to claim 9, characterized in that bearing pins (6, 7) for the lateral sides of the levers (2, 2') and the transversal swinging arms (1, 10) are arranged to pass through the side walls of each hinge portion (1, 1') consisting of a hinge cup, in longitudinal slots (23, 24) and are supported in a frame (20) that is carried on a plate (21) in a longitudinally displaceable manner, that in turn is carried in the hinge cup in a diagonally-displaceable manner, wherein adjustment devices are provided for displacement in the diagonal and longitudinal directions.

11. Wide-angle hinge pursuant to claim 10, wherein the adjustment devices are cams (26, 27).

12. Wide-angle hinge pursuant to claim 9, characterized in that one of the hinge parts is arranged to be nailed to one body part (32) and consists of a U-shaped profile hinge (30) and the other hinge part arranged for moving or swinging consists of a flat block (33) with a level underside.

13. Wide-angle hinge pursuant to claim 9, characterized in that a closing mechanism is provided that consists of a bent leaf spring (55), of which one end is supported on pins (56) between the lateral sides (35, 36) of a lever (37) that are located between an articulation connecting the levers and coupling of the lever to the hinge part (30), and another end of which impinges on a pin (57) that is carried in longitudinal slots (58) of the lateral side of the same lever (37) that are located between the articulation (47) connecting the levers and coupling of one of the transversal swinging arms (45), and the pin (57) lies adjacent to a closing curve with the desired closing characteristics, that surrounds holes of articulation of the lateral side of the respective transversal swinging arm (45) connected therewith in an articulated manner.

14. Wide-angle hinge pursuant to claim 9, wherein the web plates (12,14) of the respective levers (2,2') and transversal arms (3,3') are arranged in relation to each other in a manner such that they form an essentially continuous cover surface in the extended open position of the hinge.

15. Wide-angle hinge pursuant to claim 9, wherein the web plates (12) of the levers (2,2') have tongues (19) directed towards each other and offset to one another, such that the tongues (19) are adjacent to each other in the extended open position of the hinge.

16. Wide-angle hinge pursuant to claim 1, characterized in that bearing pins (6,7) for the lateral sides of the lever (2,2') and the transversal swinging arms (3,3') are arranged to pass through the side walls of each hinge part (1,1') consisting of a hinge cup, in longitudinal slots (23,24) and are supported in a frame (20) that is carried on a plate (21) in a longitudinally displaceable manner, that in turn is carried in the hinge cup in a diagonally-displaceable manner wherein adjustment devices are provided for displacement in the diagonal and longitudinal directions.

17. Wide-angle hinge pursuant to claim 16, characterized in that a closing mechanism is provided that consists of a bent leaf spring (55), of which one end is supported on pins (56) between the lateral sides (35, 36) of a lever (37) that are located between an articulation connecting the levers and coupling of the lever to the hinge part (30), and another end of which impinges on a pin (57) that is carried in longitudinal slots (58) of the lateral side of the same lever (37) that are located between the articulation (47) connecting the levers and coupling of one of the transversal swinging arms (45), and the pin (57) lies adjacent to a the closing curve with the desired closing characteristics, that surrounds holes of articulation of the lateral side of the respective transversal swinging arm (45) connected therewith in an articulated manner.

18. Wide-angle hinge pursuant to claim 16, wherein the adjustment devices are cams (26, 27).

19. Wide-angle hinge pursuant to claim 1, characterized in that one of the hinge parts portion is arranged to be nailed to one body part (32) and consists of a U-shaped hinge arm (30) and the other hinge part arranged for moving or swinging consists of a flat block (33) with a level underside.

20. Wide-angle hinge pursuant to claim 19, characterized in that the lateral sides (35,36; 48,49; 42,43) of the levers (37, 41) and the transversal swinging arms (38, 45) overlap each other.

21. Wide-angle hinge pursuant to claim 20, characterized in that a closing mechanism is provided that consists of a bent leaf spring (55), of which one end is supported on pins (56) between the lateral sides (35, 36) of a lever (37) that are located between an articulation connecting the levers and coupling of lever to the hinge part (30), and another end of which impinges on a pin (57) that is carried in longitudinal slots (58) of the lateral side of the same lever (37) that are located between the articulation (47) connecting the levers and the coupling of one of the transversal swinging arms (45), and the pin (57) lies adjacent to a closing curve with the desired closing characteristics, that surrounds holes of articulation of the lateral side of the respective transversal swinging arm (45) connected therewith in an articulated manner.

22. Wide-angle hinge pursuant to claim 19, characterized in that a closing mechanism is provided that consists of a bent leaf spring (55), of which one end is supported on pins (56) between the lateral sides (35, 36) of a lever (37) that are located between an articulation connecting the levers and coupling of lever to the hinged part (30), and another end of which impinges on a pin (57) that is carried in longitudinal slots (58) of the lateral side of the same lever (37) that are located between the articulation (47) connecting the levers and coupling of one of the transversal swinging arms (45), and the pin (57) lies adjacent to a closing curve with the desired closing characteristics, that surrounds holes of articulation of the lateral side of the respective transversal swinging arm (45) connected therewith in an articulated manner.

23. Wide-angle hinge pursuant to claim 1, characterized in that a closing mechanism is provided that consists of a bent leaf spring (55), of which one end is supported between lateral sides (35,36) of a lever (37) that are located between an articulation (47) connecting the levers and coupling of the lever to the hinge part (30), and another end of which impinges on a pin (57) that is carried in longitudinal slots (58) of the lateral side of the same lever (37) that are located between the articulation (47) connecting the levers coupling of one of the transversal swinging arms (45), and the pin (57) lies adjacent to a closing curve with the desired closing characteristics, that surrounds holes of articulation of the lateral side of the respective transversal swing arm (45) connected therewith in an articulated manner.

24. Wide-angle hinge pursuant to claim 1, wherein the levers (2,2') and transversal swinging arms (3,3') are formed identically so that the wide angle hinge is constructed symmetrically, although the respective lever (2,2') and transversal swinging arm (3,3') are not symmetrical to respective longitudinal axes.

25. Wide-angle hinge pursuant to claim 1, which is formed asymmetrically.

26. Wide-angle hinge pursuant to claim 25, wherein lateral sides (35,36) of one (37) of the levers (37,41) are overlapped by lateral sides (48,49) of one (38) of the transversal swinging arms (38,35), and lateral sides (42,43) of the other (41) of the levers (37,41) are bent outwardly at right angles such that these lateral sides (42,43) overlap lateral sides of the other (45) of the transversal swinging arms (38,45).

* * * * *